US005689980A

United States Patent [19]

Weinerman et al.

[11] Patent Number: 5,689,980

[45] Date of Patent: Nov. 25, 1997

[54] PUSH BUTTON LOCK

[75] Inventors: Lee S. Weinerman, Medina; Scott A. Arthurs, Brunswick, both of Ohio

[73] Assignee: The Eastern Company, Cleveland, Ohio

[21] Appl. No.: 593,702

[22] Filed: Jan. 29, 1996

[51] Int. Cl.[6] ..... E05C 1/12

[52] U.S. Cl. ..... 70/208; 292/170; 292/DIG. 31; 70/145; 70/224

[58] Field of Search ..... 70/208, 224, 145, 70/99; 292/170, DIG. 37, DIG. 31

[56] References Cited

U.S. PATENT DOCUMENTS

| | | | |
|---|---|---|---|
| D. 146,228 | 1/1947 | Merendino | D50/5 |
| D. 208,088 | 7/1967 | Banner | D10/8 |
| D. 265,965 | 8/1982 | Davis et al. | D8/302 |
| D. 270,328 | 8/1983 | Davis et al. | D8/302 |
| D. 318,217 | 7/1991 | Weinerman et al. | D8/331 |
| D. 318,606 | 7/1991 | Weinerman et al. | D8/331 |
| D. 324,635 | 3/1992 | Weinerman et al. | D8/331 |
| 625,708 | 5/1899 | Silverman | 70/387 |
| 1,257,998 | 3/1918 | Gruber | 292/170 |
| 1,287,973 | 12/1918 | Gruber | 292/170 |
| 1,558,980 | 10/1925 | Halinka | 292/126 |
| 1,586,223 | 5/1926 | Sheinman | 70/145 |
| 1,956,098 | 4/1934 | Jacobson | 292/170 |
| 2,036,154 | 3/1936 | Littledale | 292/170 |
| 2,186,666 | 1/1940 | Cereda | 292/170 |
| 2,186,903 | 1/1940 | Gleason | 292/DIG. 31 |
| 2,497,624 | 2/1950 | Nelson | 292/166 |
| 2,636,763 | 4/1953 | Chapeta et al. | 292/DIG. 37 |
| 2,674,484 | 4/1954 | Friend | 292/336.3 |
| 2,784,993 | 3/1957 | Collar | 292/DIG. 31 |
| 2,916,905 | 12/1959 | Podlesak | 292/DIG. 31 |
| 2,960,858 | 11/1960 | Webster | 292/170 |
| 3,044,815 | 7/1962 | Soss | 292/173 |
| 3,055,204 | 9/1962 | Pelcin | 70/153 |
| 3,338,610 | 8/1967 | Pelcin et al. | 292/126 |

(List continued on next page.)

FOREIGN PATENT DOCUMENTS

| | | | |
|---|---|---|---|
| 128835 | 8/1948 | Australia | 292/170 |
| 508561 | 12/1954 | Canada | 292/DIG. 31 |
| 773366 | 9/1934 | France | 292/170 |
| 76708 | 10/1961 | France | 292/170 |
| 457208 | 5/1950 | Italy | 292/170 |
| 175957 | 7/1935 | Switzerland | 292/170 |
| 1140671 | 1/1969 | United Kingdom | 292/170 |

OTHER PUBLICATIONS

General Electric Company, Pittsfield, MA, Four Page Brochure Entitled "Geloy Properties Guide," 1990.

*Primary Examiner*—Darnell M. Boucher
*Attorney, Agent, or Firm*—David A. Burge, Esq.

[57] ABSTRACT

A push button lock for mounting at an opening formed through a door panel near an edge of the door includes a flush mountable exterior housing having a thin mounting flange that encircles central housing portions that are configured to extend into the door panel opening, and a surface mountable interior housing that defines a bolt passage that carries a spring-projected slide bolt having an end formation configured to latchingly engage a suitably configured striker. The interior housing and the mounting flange of the exterior housing overlap and are clamped toward engagement with interior and exterior door panel portions that extend about the opening. The interior and exterior housings define button passages that intersect with the bolt passage, within which interior and exterior push buttons are slidably carried, with inner end regions of the buttons defining inclined cam surfaces that are configured to matingly engage separate interior-facing and exterior-facing inclined cam surfaces formed on the slide bolt so that, when either of the buttons is pressed, the engagement of its cam surface with one of the cam surfaces of the slide bolt will cause the slide bolt to retract from latchingly engaging the striker. A key-operated lock cylinder carried by the exterior housing and a locking knob carried by the interior housing each are operable to move a locking cam into and out of the path of the slide bolt to selectively permit and prevent slide bolt retraction.

32 Claims, 6 Drawing Sheets

U.S. PATENT DOCUMENTS

| | | | |
|---|---|---|---|
| 3,357,734 | 12/1967 | Pastva | 292/165 |
| 3,405,960 | 10/1968 | Wargo | 292/148 |
| 4,113,292 | 9/1978 | Gauron et al. | 292/165 |
| 4,116,027 | 9/1978 | Tannery | 70/472 |
| 4,195,867 | 4/1980 | Baillie | 292/174 |
| 4,490,999 | 1/1985 | Castle et al. | 70/432 |
| 4,520,639 | 6/1985 | Wartian | 70/110 |
| 4,912,951 | 4/1990 | Weinerman et al. | 70/99 |
| 5,018,373 | 5/1991 | Weinerman et al. | 70/99 |

PUSH BUTTON LOCK

CROSS-REFERENCE TO RELATED APPLICATIONS

Reference is made to two concurrently filed design applications, namely a design application entitled EXTERIOR FLUSH-MOUNTABLE ASSEMBLY OF A PUSH-BUTTON LOCK filed by Lee S. Weinerman and Scott A. Arthurs, application Ser. No. 29/049,683, and a design application entitled INTERIOR SURFACE-MOUNTABLE ASSEMBLY OF A PUSH-BUTTON LOCK filed by Lee S. Weinerman and Scott A. Arthurs, application Ser. No. 29/049,684, the disclosures of which are incorporated herein by reference inasmuch as these applications relate to designs that may be utilized in carrying out the preferred practice of the present invention.

BACKGROUND OF THE INVENTION

1. Field of the Invention

The present invention relates generally to a relatively light duty push button lock that is well suited for use on door panels of campers, boats, recreational vehicles and the like, wherein the lock has a flush mountable exterior housing with central portions configured to extend into a door panel opening, and a surface mountable interior housing that defines a passage that mounts a spring-projected slide bolt, with each of the exterior and interior housings defining a button passage extending in a direction that intersects with the slide bolt passage and having a separate push button slidable therein that can be depressed to retract the spring-projected slide bolt, with a key-lock assembly being carried by the exterior housing for cooperating with a locking knob carried by the interior housing for positioning a locking cam to selectively permit and prevent slide bolt retraction. More particularly, the present invention relates to a dual push button lock of the type just described wherein the exterior and interior push buttons have inner end regions that define inclined cam surfaces that interact with separate inclined cam surfaces that each preferably extends across substantially the full thickness of a generally rectangular cross-section of the slide bolt, with these interacting cam surfaces serving to retract the slide bolt when either of the exterior or interior buttons is depressed unless the locking cam is positioned to block retraction of the slide bolt, in which case neither of the buttons can be depressed.

2. Prior Art

Campers, recreational vehicles and the like often utilize door panels formed from materials of about three-fourths inch to about an inch or so in thickness that are not well suited to mount mortise-type lock mechanisms. Relatively light duty locks typically are utilized to retain such door panels closed, with these locks being operable from both interior and exterior sides, with a key being required to unlock the lock from its exterior side. Flush-mounting of exterior components of these locks often is preferred, with interior components being surface mounted. Interior components typically include a spring-projected slide bolt that latchingly engages a suitably configured striker when the door panel is closed.

While a variety of so-called "push button locks" have been proposed that utilize spring-projected slide bolts, relatively few push button lock proposals utilize both interior and exterior push buttons that engage separate cam surfaces defined by a spring-projected slide bolt for retracting the slide bolt in response to depression of either of the push buttons.

A push-button lock proposal that does utilize a manual control that can be "pushed" or "pulled" from either side of a lock to engage a pair of cam surfaces formed on a spring-projected slide bolt to retract the slide bolt is disclosed in U.S. Pat. No. 1,956,098 issued Apr. 24, 1934 to Jacobson. It will be noted, however, that the Jacobson proposal relates to a mortise-type lock; that the lock does not utilize individual interior and exterior push buttons but rather employs a single elongate manual control having interior and exterior ends that may be "pushed" or "pulled" to retract the slide bolt; that the slide bolt itself has only very short, very small sized cam surfaces defined on it (these cam surfaces are required to be quite short inasmuch as only half of the thickness of the slide bolt is available to devote to each of these inclined cam surfaces) that, due to their small size, are subject to undue wear during the service life of the lock; and, that in order to ensure that a sufficient amount of slide bolt retraction will take place when inclined cam surfaces of the manual push-pull control interact with the short-length cam surfaces formed on the slide bolt, it is necessary for the intersecting cam surfaces that are formed on the manual push-pull control to be quite lengthy, with the resulting V-shaped notch that is defined by these intersecting cam surfaces nearly severing the push-pull control at a location where the push-pull control needs to be able to withstand substantial shear force loads applied to it by the slide bolt—an arrangement that clearly invites component failure.

What the Jacobson proposal does properly point out, however, is that, if a slide bolt is to define a pair of inclined cam surfaces that each is to interact with a separate inclined cam surface defined by push-type controls, it is desirable to position both of the inclined cam surfaces of the slide bolt at very nearly the same location along the length of the slide bolt—which is a difficult objective to achieve unless an undesirable compromise is made in diminishing the size of the inclined cam surfaces that are defined by the slide bolt. As will be noted as the description of the present invention unfolds, the present invention addresses this need in a novel way by providing a nested arrangement of two slide-bolt-defined cam surfaces that each can extend across the full thickness of a rectangular slide bolt cross-section, with neither of the inclined cam surfaces interfering in any way with the other—by which arrangement, two sizable, inclined, oppositely-facing cam surfaces can be defined on a slide bolt at substantially the same location (or at closely spaced locations) along the length of the slide bolt.

While the Jacobson and other push button lock proposals have been forthcoming over a period of many years, there has nonetheless remained a need for a simple, reliable, dual-push-button lock that utilizes flush mountable exterior components and surface mountable interior components, and that provides reliable and smooth operating interconnections between a pair of oppositely acting push buttons and a spring-projected slide bolt—with the lock preferably also including a knob controlled interior locking capability and a key controlled exterior locking capability.

SUMMARY OF THE INVENTION

The present invention addresses the foregoing and other needs and drawbacks of the prior art by providing a novel and improved push button lock for mounting on a door panel, with the lock including an exterior housing and an interior housing that are configured to be clamped toward engagement with opposite sides of the door panel to mount the lock on the door panel, with a selected one of the housings defining a slide bolt channel within which an elongate, spring-projected slide bolt is carried for movement between latched and unlatched positions, and with each of the housings defining a separate push button passage that carries a separate push button, with the button passages extending along imaginary centerlines that preferably intersect at closely spaced locations along the length of the slide bolt passage, with the slide bolt defining separate exterior-facing and interior-facing inclined cam surfaces at these closely spaced intersections, and with each of the slide-bolt-defined inclined cam surfaces being engaged by an inclined cam surface formed on an inner end region of a separate one of the push buttons to interact therewith in a manner that will permit either of the push buttons, when depressed, to retract the slide bolt from its latched position.

A feature of the preferred practice of the present invention resides in utilizing an arrangement of oppositely facing, inclined cam surfaces formed on a slide bolt at closely spaced locations along the length of the slide bolt—inclined cam surfaces that do not in any way interfere with each other and that can, in fact, be formed at precisely the same location along the length of the slide bolt with each of the inclined cam surfaces extending across the full thickness of the slide bolt, if desired. Such an arrangement is permitted without sacrificing smooth interaction of the push buttons with the slide bolt by forming one of the inclined cam surfaces within a centrally located cavity of the slide bolt, and by forming the other of the inclined cam surfaces in a split-apart fashion, with half located on one side of the slide bolt, and with the other half located on the opposite side of the slide bolt—so that, in effect, one of the inclined cam surfaces is nested centrally between split-apart halves of the other of the inclined cam surfaces. This novel arrangement gives the designer complete flexibility in locating two oppositely-facing, inclined cam surfaces at substantially any two desired locations along the length of the slide bolt with the concern that one of the cam surfaces will "interfere" with the other being nicely sidestepped.

In preferred practice, the exterior housing is provided with a flush mountable configuration that utilizes a thin mounting flange that encircles a central portion of the exterior housing that provides a centrally located finger-receiving recess which opens through a front surface of the exterior housing; and the interior housing takes the form of a surface mountable assembly that defines the slide bolt passage and that has finger-receiving recesses defined along opposite side wall portions (extending substantially parallel to the slide bolt passage at locations on opposite sides thereof) that aid one in grasping the interior housing to open and close the door panel.

In accordance with another feature of preferred practice, a key-operated lock cylinder and a manually operable locking knob are connected to the exterior and interior housings, respectively, for selectively positioning a locking cam in "locked" and "unlocked" positions, with the locking cam serving to obstruct slide bolt retraction when locked, but posing no obstacle to slide bolt retraction when unlocked. The locking cam preferably is rigidly connected to the locking knob so as to constitute a component that is connected to the interior, surface-mountable housing—with a forwardly facing opening being defined by the locking cam/locking knob assembly into which a rearwardly extending projection of the key-operated lock cylinder extends to operably connect the key-operated lock cylinder to the locking cam.

Still another feature of preferred practice resides in forming the surface mountable interior components of the lock as an assembly that does not need to be disassembled or changed in any way to enable the lock to be installed on door panels that differ in thickness, typically with the range of about three-fourths inch to about one inch. To accommodate different door panel thicknesses, exterior push buttons of a variety of lengths may be provided; and, if the lock includes a key-locking cylinder that is carried by the exterior housing, key-locking cylinders of a variety of lengths are likewise provided—it being noted that the exterior push button and the key-locking cylinder are the only "operational components" that extend through the door panel opening to operationally connect with other lock components that are carried by one or the other of the exterior and interior housings.

In preferred practice, each of the exterior and interior housings are defined, at least in large measure, from rigid plastics material utilizing techniques of injection molding, with the material selected for this purpose preferably being an acrylic-styrene-acrylonitrile (ASA) thermoplastic resin that is weather and ultraviolet light resistant, an example being an ASA polymer sold by General Electric Company, Pittsfield, Mass. 01201 under the registered trademark GELOY. The slide bolt and push buttons also are preferably formed from this type of material—although die cast metal and other materials also clearly can be used, as those who are skilled in the art will readily understand.

BRIEF DESCRIPTION OF THE DRAWINGS

These and other features, and a fuller understanding of the present invention may be had by referring to the following description and claims, taken in conjunction with the accompanying drawings, wherein:

DESCRIPTION OF THE PREFERRED EMBODIMENT

Referring to FIGS. 1–3 and 5–6, a push button lock that embodies the best mode known to the inventors for carrying out the preferred practice of the present invention is indicated generally by numeral 100. The lock 100 includes what will be referred to as an "exterior assembly" 150 and an "interior assembly" 350.

Figure 2:
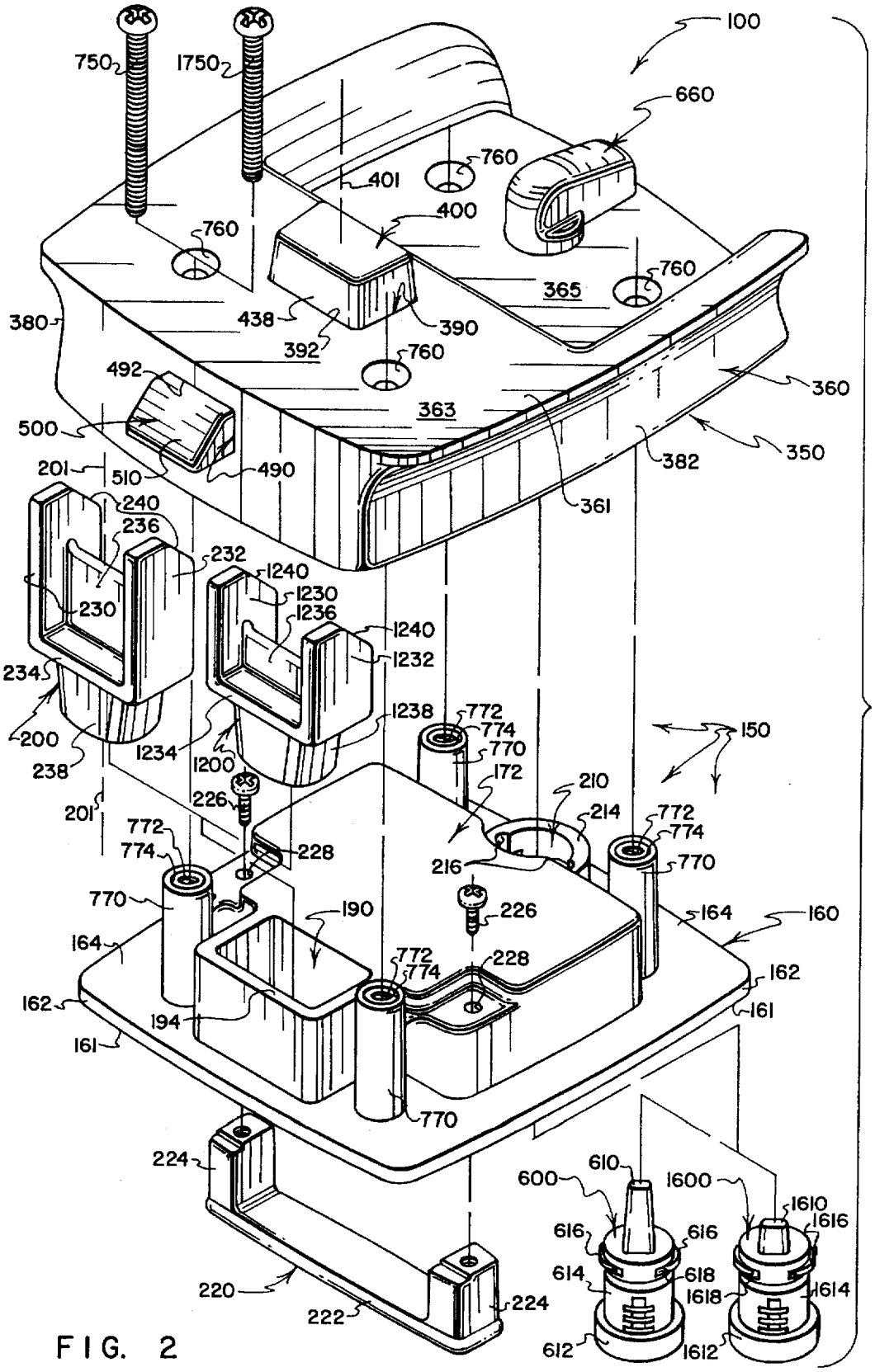
FIG. 2 is an exploded perspective view showing front portions of the interior assembly (with its components fully assembled), and rear portions of the exterior assembly (with its components disassembled), with alternate lengths of exterior push buttons, key-locking assemblies and fasteners being depicted to illustrate how the lock easily can be adapted for installation on door panels of differing thickness simply by utilizing substitute components of suitable length.
Figure 3:
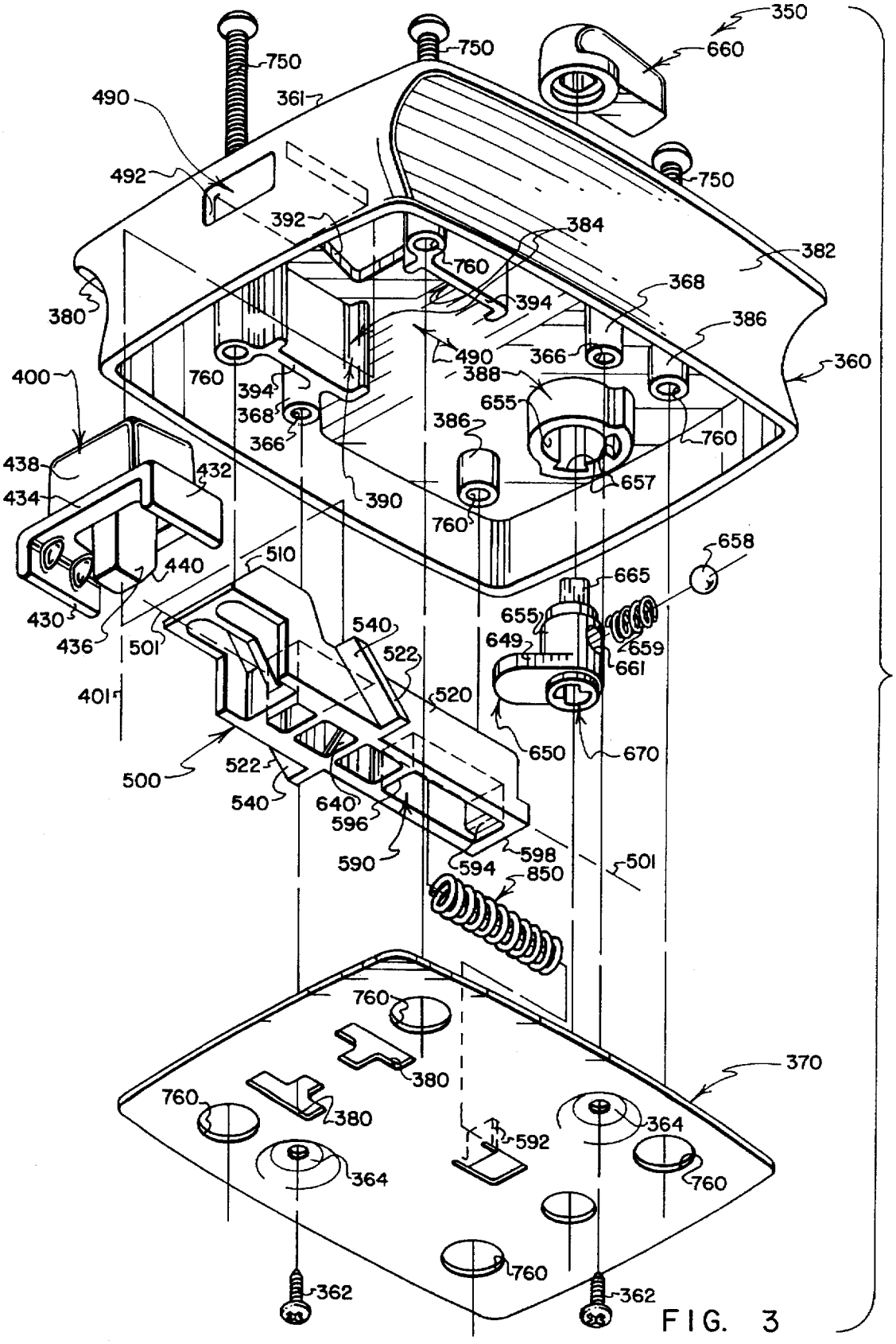
FIG. 3 is an exploded perspective view showing rear portions of the interior assembly with its components disassembled.
Figure 5:
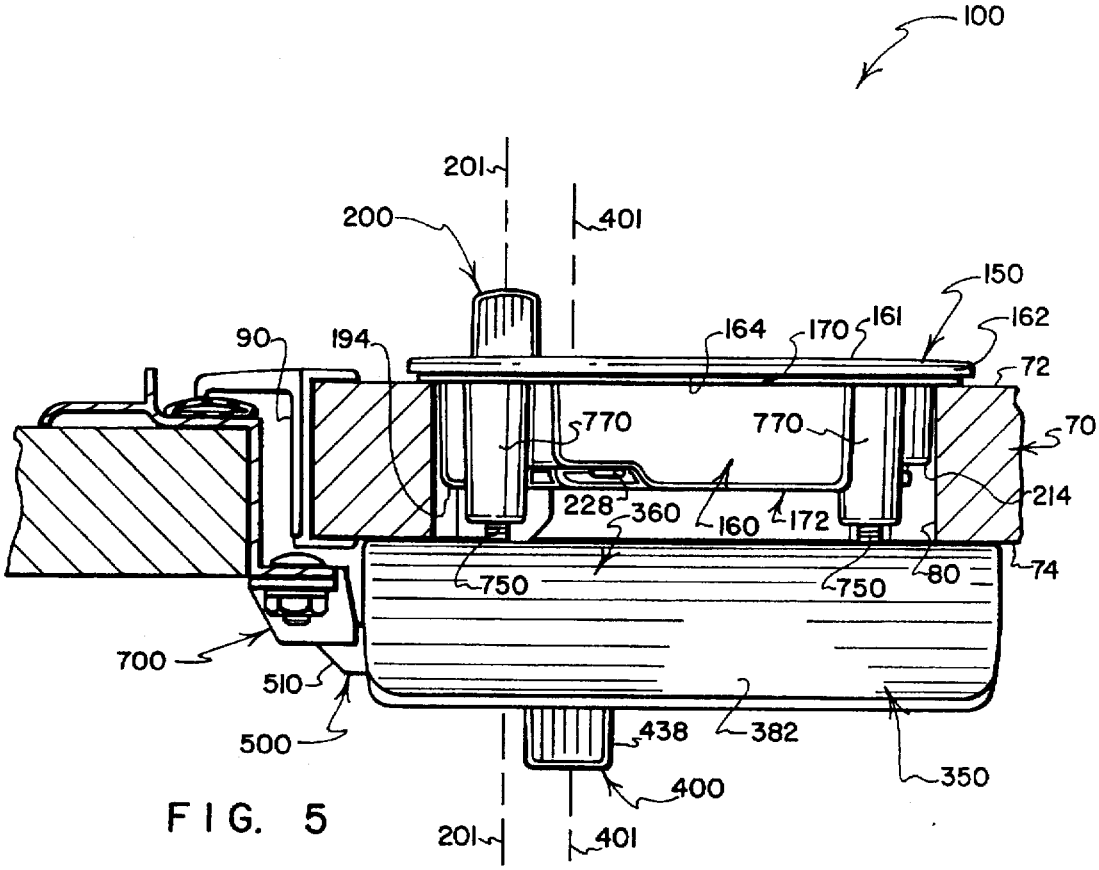
FIG. 5 is a top plan view showing the lock mounted on a door panel having a thickness of about an inch, showing one form of suitably configured striker mounted on portions of a door frame, with door frame and panel portions being depicted in cross-section.
Figure 6:
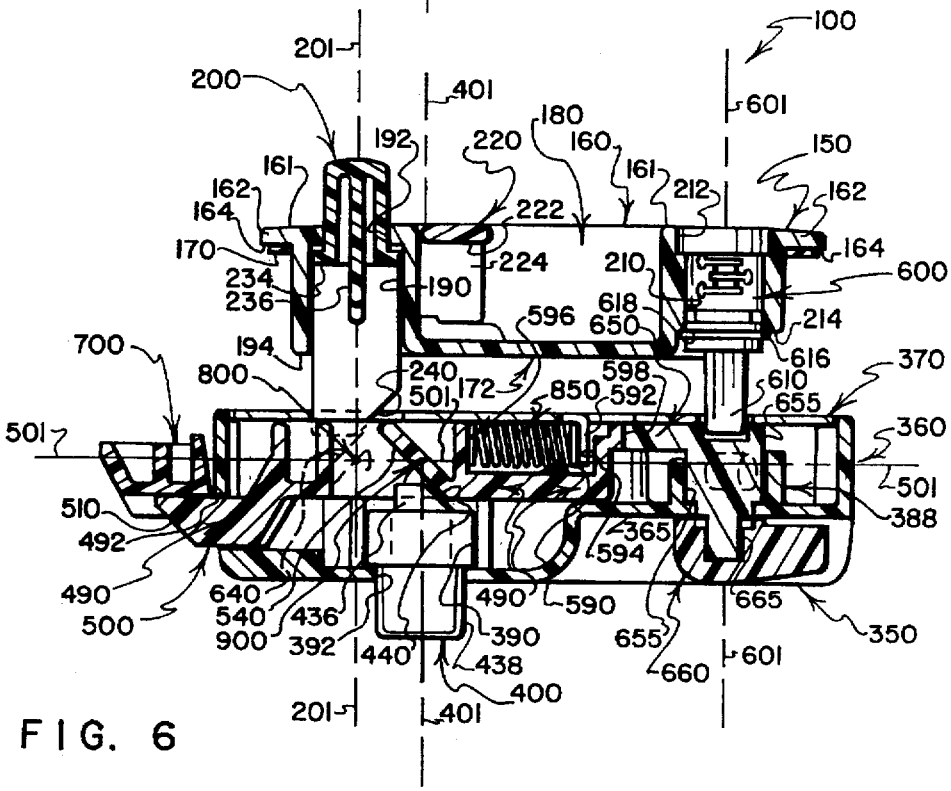
FIG. 6 is a top plan view similar to FIG. 5 but with portions of the lock and the striker broken away and shown in cross-section, and with door frame and panel portions omitted.

In overview, the exterior and interior assemblies 150, 350 have exterior and interior housings 160, 360 that define parallel extending button passages 190, 390 (both are shown in FIG. 6, but see also FIG. 2 for the passage 190 and FIG. 3 for the passage 390). Exterior and interior push buttons 200, 400 are slidably carried in the passages 160, 360, respectively. The interior assembly 350 also defines a slide bolt passage 490 (see FIGS. 3 and 6) that extends transversely with respect to the button passages 190, 390, and a spring-projected slide bolt 500 (see FIGS. 3–4) is slidably carried therein. The slide bolt 500 has a tapered outer end region 510 that can be "slammed" into latching engagement with a suitably configured striker, one typical form of which is indicated by the numeral 700 in FIGS. 5–6, with an alternate striker 1700 being shown in FIGS. 7–8.

Referring to FIG. 6, a key operated lock cylinder 600 (see also FIG. 2) is carried by the exterior housing 160 and has a rearwardly projecting portion 610 of generally rectangular shape that connects with a locking cam 650 (see also FIG. 3) that, together with a locking knob 660, are pivotally mounted by the interior assembly 350. The key operated lock cylinder 600 and the locking knob 660 are each capable of pivoting the locking cam 650 between a "locked" position (shown in solid lines in FIG. 4, and in FIG. 6) wherein the locking cam 650 obstructs retraction of the slide bolt 500 (i.e., the cam 650 is positioned to prevent "unlatching" movement of the slide bolt 500), and an "unlocked" position (shown in phantom in FIG. 4) wherein the locking cam 650 permits sufficient retraction of the slide bolt 500 to withdraw the outer end region 510 of the slide bolt 500 from latching engagement with a suitably configured striker.

To permit the key operated lock cylinder 600 to have a single orientation (depicted in FIG. 1) at which a suitably configured key (not shown) can be removed from the lock cylinder 600 regardless of the orientation of the locking cam 650 (i.e., regardless of whether the locking cam 650 is at one end of its range of movement where its "locked" position is defined, or at the other end of its range of movement where its "unlocked" position is defined); and, to permit the locking knob 660 to rotate through a ninety degree range of movement to "lock" or "unlock" the locking cam 650 without being prevented from carrying out such movements by the "locked" lock cylinder 600, a type of connection that is commonly used to couple exterior and interior operators of deadbolt and mortise-type locks is employed to couple the rearwardly extending member 610 of the lock cylinder 600 with the locking cam 650.

Such a connection (which is known to those who are skilled in the art as a "ninety degree lost motion connection") is defined by providing a "figure-eight shaped" recess 670 (see FIGS. 1 and 3) on the locking cam 650, into which the rectangular end region 610 of the lock cylinder 600 extends (see FIG. 6). The "figure-eight shaped" recess 670 is has a configuration that permits limited relative movement to take place between the locking cam 650 and the end region 610—in fact, it will permit a full ninety degrees of relative movement to take place.

This "ninety degrees of freedom of movement" is precisely what is needed in order to permit the rectangular end region 610 of the lock cylinder 600 to rotate back through a ninety degree range of movement to its key removal position (which rotation takes place about an imaginary axis 601 that extends centrally through the lock cylinder 600 and through the locking knob 660—see FIG. 6) after the key cylinder 600 has been operated to position the locking cam 650 in its "locked" position—it being recognized that, without this ninety degree freedom of movement, rotation of the end region 610 back through ninety degrees of movement to permit key removal at a desired orientation would also cause corresponding "unlocking" movement of the locking cam 650 (which is not what is desired after the key cylinder 600 has been operated to deliberately position the locking cam 650 in its "locked" position).

Likewise, this "ninety degrees of freedom of movement" also is precisely what is needed in order to permit the locking knob 660 to pivot the locking cam 650 through ninety degrees of movement between its "locked" and "unlocked" positions—without being hindered in carrying out this movement by the presence within the "figure-eight-shaped" recess 670 of the locked-in-place end region 610. In short, the "lost motion connection" that is provided between the locking cam 650 and the rectangular end region 610 of the lock cylinder 600 permits a variety of needed relative movements to take place, and performs this function in a reliable and accepted manner that is well known to those who are skilled in the art.

Figure 1:
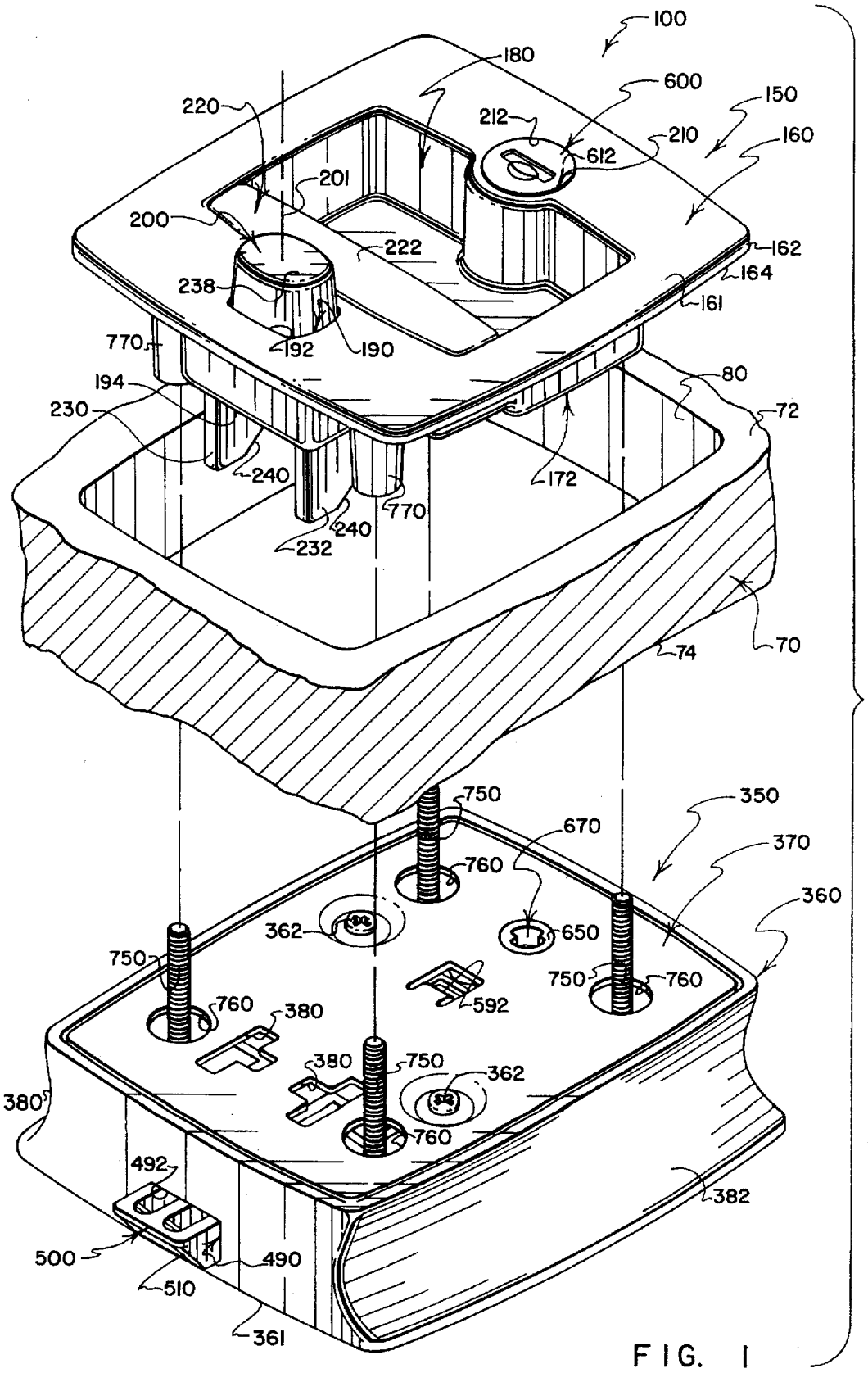
FIG. 1 is an exploded perspective view showing front portions of an exterior assembly and rear portions of an interior assembly of a push-button lock that embodies the preferred practice of the present invention, with door panel portions being shown that define an opening at which the exterior and interior assemblies are installed.

Referring to FIGS. 1, 5 and 6, the lock 100 is mountable on a door panel 70 (having a thickness of about an inch as measured between its front and rear surfaces 72, 74) adjacent an opening 80 that is formed through the door panel 70 near a door edge 90 (see FIG. 5). Referring to FIG. 2, when configured for mounting on the relatively thick door panel 70, the lock 100 has a relatively long exterior push button 200, a relatively long lock cylinder 600, and utilizes four relatively long threaded fasteners 750 (all four are shown in FIG. 1) that 1) extend through a spaced array of four holes 760 (see FIG. 2) formed through the interior assembly 350, 2) extend through the door panel opening 80, and 3) are threaded into internally threaded holes 772 that are defined by threaded metal inserts 774 which are installed in rear end regions of rearwardly extending leg formations 770 of the exterior housing 160. Tightening the fasteners 750 in place draws the exterior and interior assemblies 150, 350 toward clamping engagement with the door panel 70 to mount the lock 100 on the door panel 70.

Figure 7:
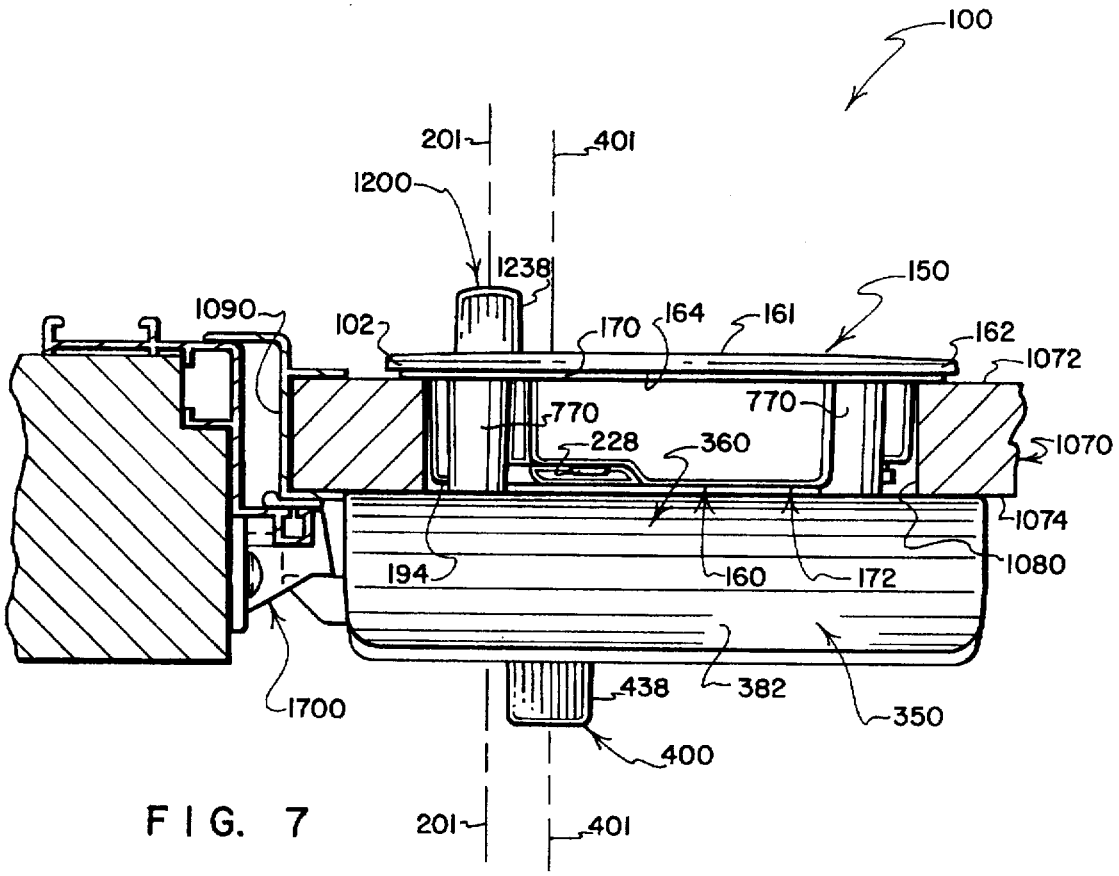
FIG. 7 is a top plan view showing the lock mounted on an alternate form of door panel having a thickness of about three-fourths inch, showing an alternate form of suitably configured striker mounted on portions of an alternate form of door frame, with the door frame and panel portions being depicted in cross-section; and, FIG. 8 is a top plan view similar to FIG. 7 but with portions of the lock and the striker broken away and shown in cross-section, and with door frame and panel portions omitted.
Figure 8:
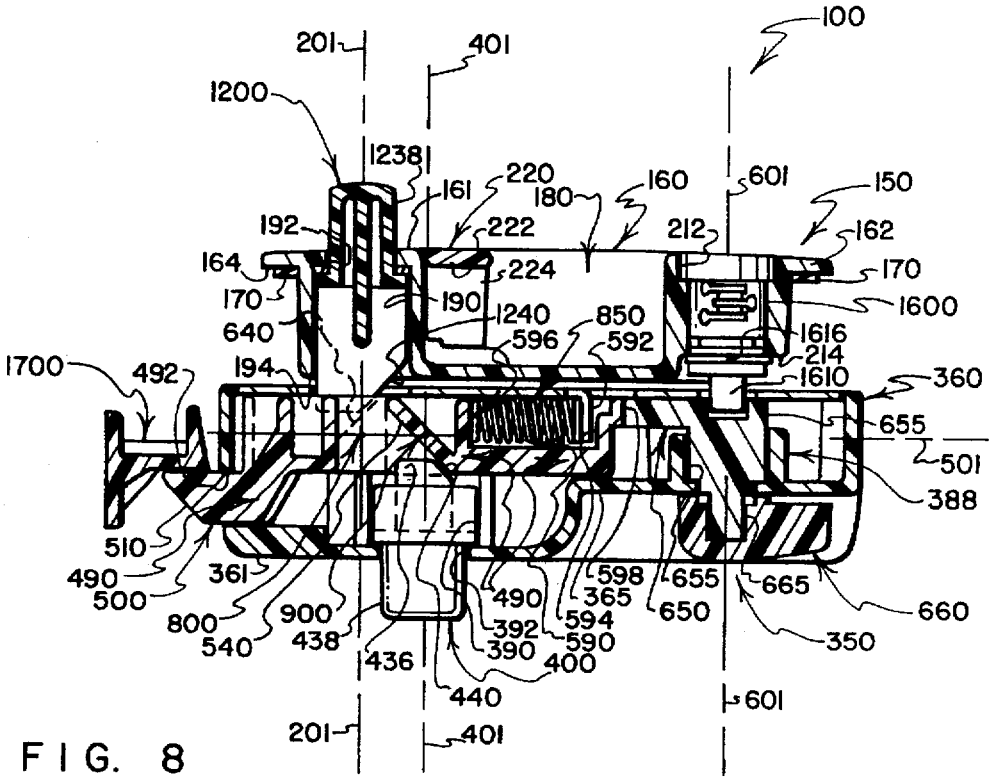

If, however, the lock 100 is to be mounted on an alternate door panel having a thickness that differs from the thickness of the door panel 70, the fasteners 750, the lock cylinder 600 and the exterior push button 200 are replaced with substitutes of that are of more appropriate lengths (i.e., that are slightly longer if the alternate door panel is slightly thicker, or that are slightly shorter if the alternate door panel is slightly thinner than the inch-thick door panel 70). Referring, for example, to FIGS. 7 and 8 wherein the lock 100 is shown mounted on an alternate door panel 1070 that has a thickness of only about three-quarters inch, it will be seen 1) that fasteners 1750 of shorter length than the fasteners 750, 2) that a key operated lock cylinder 1600 that is of shorter length than the cylinder 600, and 3) that an exterior push button 1200 that is shorter in length than the button 200 are utilized. In FIG. 2 one of the threaded fasteners 750 is shown in side-by-side comparison with one of the threaded fasteners 1750, as are the exterior push buttons 200, 1200 and the lock cylinders 600, 1600.

While the installation of the lock 100 as depicted in FIGS. 5 and 6 utilizes a striker 700 that differs in configuration from the striker 1700 that is shown in FIGS. 7 and 8, it will be understood that the present invention relates to features of the lock 100 not to features of the strikers 700, 1700; and that strikers of a wide variety of other forms may be used with the lock 100. Likewise, it will be understood that the differing door panel and frame constructions of FIGS. 5–6 and 7–8 are shown to exemplify a wide variety of door panel and frame constructions with which the lock 100 may be used.

Because the installation of the lock 100 on the inch-thick door panel 70 differs from the installation of the lock 100 on the three-fourths-inch-thick door panel 1070 only in that components 750, 600, 200 are replaced by components 1750, 1600, 1200 of appropriate length, it will be understood that the description that follows of features of the lock 100 as depicted in FIGS. 1–6 is equally applicable to the lock 100 as depicted in FIGS. 7–8. Except for substitution of the components 1750, 1600, 1200 for the components 750, 600, 200, the lock installation of FIGS. 7–8 is identical to and functions the same as the lock installation of FIGS. 5–6. Components that are "identical" in the lock installations of FIGS. 5–6 and 7–8 are indicated by reference numerals that are identical. Components that "correspond" in function (but differ slightly in configuration or length, etc.) are designated in FIGS. 7–8 by numerals that "correspond" to the reference numerals used in FIGS. 5–6 (i.e., the reference numerals in FIGS. 7–8 that "correspond" to those used in FIGS. 5–6 simply have a value "one thousand" added thereto).

Figure 4:
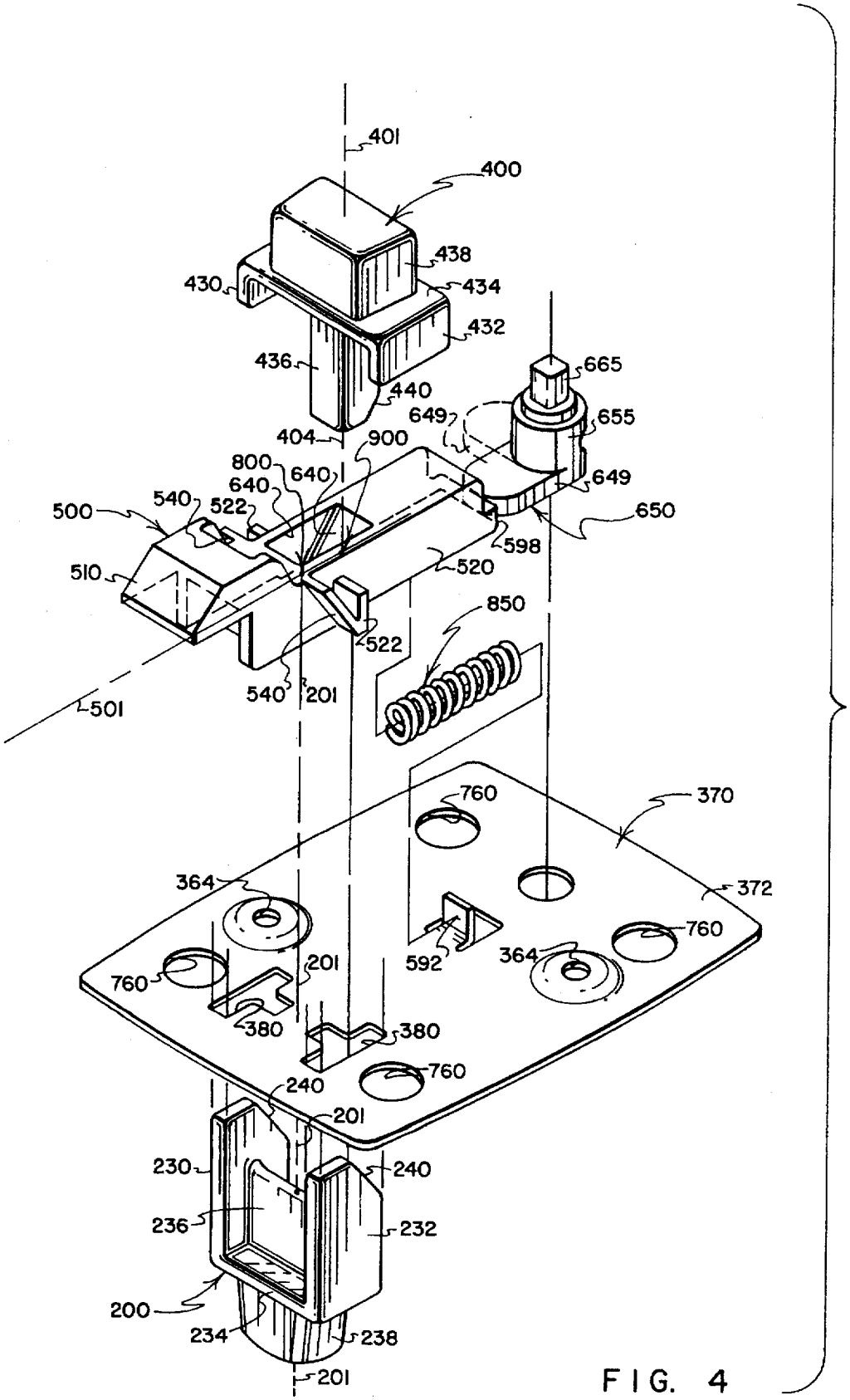
FIG. 4 is a perspective view of showing selected operating components of the lock and illustrating how imaginary centerlines that extend centrally along the paths of movement of the exterior and interior push buttons intersect at spaced locations with an imaginary centerline that extends centrally through the main body of the slide bolt and centrally along a path of movement followed by the main body portion of the slide bolt, with a locking cam depicted in solid lines in its locked position, and in phantom in its unlocked position.

Referring to FIGS. 4 and 6, the manner in which the exterior and interior push buttons 200, 400 and the slide bolt 500 are arranged and interact is of some consequence and deserves mention before turning to a more detailed description of the various components of the lock 100. The slide bolt 500 has a main body portion 520 that has a generally rectangular cross-section and extends along almost all of the length of the slide bolt 500 except for the outer end region 510 that is offset from the main body portion 520. The main body portion 520 can be thought of as having an "imaginary centerline" or "imaginary center axis" 501. Likewise, the exterior and interior push buttons 200, 400 also can be thought of as having "imaginary centerlines" or "imaginary center axes" 201, 401, respectively, that extend centrally through major portions thereof. The imaginary center axes 201, 401 of the exterior and interior buttons 200, 400 extend parallel to each other and intersect the imaginary center axes 501 of the slide bolt at locations (that are closely spaced along the length of the slide bolt 500) that are identified in FIGS. 4 and 6 by reference numerals 800, 900, respectively.

In the general vicinity of the intersection 800 of the exterior button centerline 201 with the slide bolt centerline 501, the slide bolt 500 defines a pair of identical inclined cam surfaces 540 (located on opposite sides of the main body portion 520 of the slide bolt 500) that are engaged by a pair of inclined cam surfaces 240 which are formed on spaced, rearwardly extending legs 230, 232 of the exterior push button 200. It is the interaction of the inclined cam surfaces 240, 540 that permits the exterior push button 200 to retract the slide bolt 500 in opposition to the action of a compression coil spring 850 (that is interposed between the slide bolt 500 and the interior housing 360, as will be more fully described later herein).

Likewise, in the general vicinity of the intersection 900 of the interior button centerline 401 with the slide bolt centerline 501, the slide bolt 500 defines an inclined cam surface 640 (located within a central cavity 642 of the slide bolt 500) that is engaged by an inclined cam surface 440 which is formed on a central projection 436 of the interior push button 400. It is the interaction of the inclined cam surfaces 440, 640 that permits the interior push button 400 to retract the slide bolt 500 in opposition to the action of the compression coil spring 850.

A number of feature derive from utilizing completely separate cam surfaces 540, 640 that are formed on the slide bolt 500 in a "nested" manner with the cam surface 640 located centrally between what can be regarded as "spaced halves" of the cam surface 540. This arrangement of the cam surface 640 and the spaced-apart "halves" of the cam surface 540 provides a means by which each of the cam surfaces 540, 640 can be located at substantially any desired location along the length of the slide bolt 500, with there being no associated worry about either of these cam surfaces interfering with the location of or the functioning of the other. This arrangement permits each of the cam surfaces 540, 640 to extend across the full thickness of the generally rectangular cross-section of the main body of the slide bolt 500—and thereby avoids the "half-thickness, small size, undue wear" pitfalls of the aforementioned Jacobson proposal.

This arrangement also ensures that the neither the interaction of the cam surfaces 240, 540 nor the interaction of the cam surfaces 440, 640 will tend to cause twisting or binding of any of the components 200, 400, 500—which is true because the cam surfaces 440, 640 interact at a location that is centered about the intersection of the axes 401, 501; and because the cam surfaces 240, 540 interact at locations spaced equal distances on opposite sides of the intersection of the axes 201, 501.

Moreover, this arrangement provides cam surface interactions that (due to the relatively long lengths of the cam surfaces 540, 640—which preferably extend at inclined angles across substantially the full thickness of the slide bolt 500) will cause a sufficient amount of slide bolt retraction (in response to depression of either of the push buttons 200, 400) to ensure that the outer end region 510 of the slide bolt 500 definitely will retract sufficiently to disengage whatever form of striker is being used with the lock 100. Because some striker configurations require more slide bolt retraction to ensure striker disengagement than do others, this feature of the lock 100 can represent a matter of some consequence.

Turning now to a more detailed description of the components of the lock 100, and referring to FIGS. 1, 2, 5 and 6, the exterior housing 160 is a molded, one-piece member that has a slightly curved front surface 161. The front surface 161 is defined, in part, by a thin, perimetrically extending mounting flange 162 that, near its perimeter, also defines a substantially flat rearwardly facing surface 164. The rear surface 164 is engageable with portions of the front surface 72 of the door panel 70 that extend about the opening 80—or can cooperate with the front surface 72 to clamp a suitably configured gasket 170 (see FIGS. 5 and 6) therebetween to establish a weather tight seal between the housing 160 and the door panel 70 at a location extending about the exterior end of the door panel opening 80.

Referring to FIGS. 2 and 6, the exterior housing 160 has central portions 172 that extend rearwardly from the mounting flange 162 (and that have a configuration that permits the central portions 172 to extend into the door panel opening 80) for defining 1) a forwardly opening, finger-receiving recess 180 together with 2) the button passage 190 that slidably mounts the exterior push button 200, and 3) a generally cylindrical lock mounting passage 210 wherein the key operated lock cylinder 600 is mounted.

Referring to FIG. 6, the button passage 190 has a front end region that is of diminished size, and that defines an opening 192 where it opens through the front surface 161 of the housing 160; and has a rear end region that is terminated by a flat, rearwardly facing surface 194. The lock mounting passage 210 has a front end region 212 of enlarged diameter that opens through the front surface 161 of the housing 160; and has a rear end region that is terminated by a flat, rearwardly facing surface 214.

Referring to FIGS. 2 and 6, a molded, one-piece handle member 220 is provided that fits into one side of the forwardly-facing recess 180. The handle 200 has a cross-bar 222 that bridges between a pair of rearwardly extending end regions 224. Referring to FIG. 2, threaded fasteners 226 extend through holes 228 formed in the housing 160 to rigidly connect the handle 220 to the housing 160. By this arrangement, the cross-bar 222 overlies a portion of the forwardly-facing recess 180 to provide a finger-graspable formation that can be used to move and position the door panel 70, and that can be grasped by selected fingers of one's hand when the thumb or another finger is used to depress the exterior button 200.

Referring to FIGS. 2 and 4, the exterior push button 200 is a molded, one-piece member that has a generally U-shaped body that is defined by a pair of spaced, parallel extending legs 230, 232 that are connected by a transversely extending base leg 234 and by a transversely extending web 236. A button formation 238 joins with the base leg 234 and is configured to project through the front wall opening 192 of the button passage 190 when the exterior button 200 is in its "normal" position, as depicted in FIGS. 1, 5 and 6.

Defined near rear end regions of the parallel extending legs 230 are the identically configured, inclined cam surfaces 240. The legs 230, 232 of the exterior button 200 are sufficiently long to extend through a pair of openings 380 formed in a backing plate 370 of the interior assembly 350 to position the cam surfaces 240 in engagement with identically configured, inclined cam surfaces 540 that are defined by transversely extending projections 522 of the slide bolt 500. It is the engagement of the cam surfaces 240 with the cam surfaces 540 (taken together with the biasing action of the compression coil spring 850) that causes the exterior push button 200 to be held in its "normal" position wherein the button formation 238 projects through the front wall opening 192, as shown in FIGS. 1, 5 and 6. The "imaginary centerline" or "imaginary center axis" 201 extends centrally through the button 200; extends centrally through the button passage 190; extends centrally through the button passage opening 192; and intersects with the centerline or center axis 501 of the slide bolt at the point 800 (see FIGS. 4 and 6).

The lock cylinder assembly 600 is of a conventional, commercially available type having an enlarged diameter head 612 that seats within the enlarged diameter front end region 212 of the lock mounting passage 210, and a generally cylindrical tumbler-carrying body 614. A spring retaining ring 616 is carried in a groove 618 of the body 614 and projects outwardly from the groove 618 to engage the flat surface 214 at the rear end of the passage 210 to retain the lock cylinder assembly 600 in place on the exterior housing 160.

Referring to FIG. 2, a pair of axially extending grooves 216 are formed in opposite sides of the lock mounting passage 210 to receive tumbler ends that project from opposite sides of the tumbler-carrying body 614 when no correctly configured key is inserted into the lock cylinder assembly 600 to retract the tumblers so that the lock cylinder assembly 600 can rotate within the passage 210—an arrangement that is quite commonly used with lock cylinder assemblies to selectively permit and prevent cylinder rotation relative to a housing in which the lock cylinder is installed, as will be readily understood by those who are skilled in the art.

Referring primarily to FIG. 3, the interior assembly 350 includes the main interior housing 360 which preferably is formed by injection molding; the rear cover plate 370 which preferably is formed as a steel stamping; a pair threaded fasteners 362 that extend through holes 364 that are formed in the cover plate 370, and are threaded into holes 366 formed into rearwardly extending projections 368 of the main housing 360; the interior push button 400; the slide bolt 500; the locking cam 650; and the compression coil spring 850.

Referring to FIG. 2, the interior housing 360 is a molded, one-piece member that has a complexly shaped front surface 361 having a main portion 363 through which an opening 392 is formed to receive a button formation 438 of the interior push button 400, and having a recessed portion 365, adjacent the location of the locking knob 660. Two of the mounting holes 760 for the threaded fasteners 750 are formed through the main portion 363, and two of the holes 760 are formed through the recessed portion 365.

Opposite sides 380, 382 of the interior housing 360 are concavely curved (they define what amount to "finger receiving recesses" that extend along opposite sides of the housing 360) to facilitate one's grasping the housing 360 to position the door panel 70 or to steady one's hand when depressing the push button 400. The tapered end region 510 of the slide bolt 500 projects through an opening 492 formed in one end of the housing 360.

Referring principally to FIG. 3, the interior of the housing 360 includes a number of formations such as those that are indicated by the numerals 384, 386 and 388. The formations 384 are situated on opposite sides of the junction of the slide bolt passage 490 with the interior button passage 390 so as to define portions of these passages. The formations 384 also define a pair of the mounting holes 760 (through which the mounting fasteners 750 extend); and, the holes 366 (into which the fasteners 362 are threaded, which hold the cover plate 370 in place on the housing 360). The formations 386 define the other pair of mounting holes 760. The formation 388 defines portions of a generally cylindrical passage 655 that houses a generally cylindrical stem 656 of the locking cam 650. A pair of grooves 657 are formed in the passage 655 that receive portions of a detent ball 658 that is carried together with a small compression coil spring 659 in a passage 661 formed in the stem 656, it being understood that the interaction of the detent ball 658 with one or the other of the grooves 657 assists in retaining the locking cam 650 in one or the other of its "locked" and "unlocked" positions.

Referring to FIGS. 3 and 6, the button passage 390 has a front end region that is of diminished size, and that defines the opening 392 where it opens through the front surface 361 of the housing 360; and has a rear end region that is terminated by flat surfaces 394 of the formations 384. The slide bolt passage 490 is defined, in part, by an inwardly facing surface 372 of the back plate 370, in part by the rearwardly extending formations 384 of the housing 360, and, in part by the end wall opening 492 through which the outer end 510 of the slide bolt 500 projects.

Referring to FIGS. 3 and 4, the interior push button 400 is a molded, one-piece member that has a generally U-shaped body that is defined by a pair of spaced, parallel extending legs 430, 432 that are connected by a transversely extending base leg 434. A button formation 438 joins with the base leg 434 and is configured to project through the front wall opening 392 of the button passage 390 when the interior button 400 is in its "normal" position, as depicted in FIGS. 1, 5 and 6. A central projection 436 of the button 400 extends rearwardly from the button formation 438. The inclined cam surface 440 is defined by the projection 436, which extends into the slide bolt channel 490 to engage the inclined cam surface 640 defined by the slide bolt 500.

It is the engagement of the cam surface 440 with the cam surface 640 (taken together with the biasing action of the compression coil spring 850) that causes the interior push button 400 to be held in its "normal" position wherein the button formation 438 projects through the front wall opening 392, as shown in FIGS. 2, 5 and 6. The "imaginary centerline" or "imaginary center axis" 401 extends centrally through the button 400; extends centrally through the button passage 390; extends centrally through the button passage opening 492; and intersects with the centerline or center axis 501 of the slide bolt at the point 900 (see FIGS. 4 and 6).

Referring to FIG. 6, the spring-projected slide bolt 500 is a one-piece molded member, the body 520 of which is hollowed out at a plurality of locations, with a spring retaining chamber 590 being defined near the inner end of the slide bolt 500. Extending into one end of the chamber 590 is a projection 592 of the back plate 370 which engages an end wall 594 of the chamber 590 when the slide bolt 500 is in its normal "latched" position. The compression coil spring is interposed between the projection 592 and an opposite end wall 596 of the chamber 590, and serves to bias the slide bolt toward its "latched" position.

The slide bolt 500 has an inner end region 598 that is engaged by the locking cam 650 when the locking cam 650 is in its "locked" position (as depicted in solid lines in FIG. 4). When the slide bolt end surface 598 is engaged by the "locked" locking cam 650, the slide bolt 500 is prevented from retracting to its "unlatched" position. When the locking cam 650 is pivoted to its "unlocked" position (as depicted in phantom in FIG. 4), the slide bolt 500 may be retracted in opposition to the action of the spring 850 to a position where the slide bolt end surface 598 engages a side surface 649 of the locking cam 650. The knob 660 is rigidly attached to a square formation 665 of the locking cam 650 and provides one means by which the locking cam 650 can be pivoted about the axis 601 between its "locked" and "unlocked" positions (it being recalled from the discussion presented earlier that operation of the lock cylinder 600 provides another means for effecting such movements of the locking cam 650).

As will be apparent from the foregoing description, the lock 100 provides a simple, versatile, compact and novel arrangement of components that cooperate to provide a light duty lock that is well suited for use on campers, recreational vehicles, boats and the like. The novel interaction that is provided between the push buttons 200, 400 and the slide bolt 500 yields a number of advantages which have been enumerated above.

While the invention has been described with a certain degree of particularity, it will be understood that the present disclosure of the preferred embodiment has been made only by way of example, and that numerous changes in the details of construction and the combination and arrangement of elements can be resorted to without departing from the true spirit and scope of the invention as hereinafter claimed. It is intended that the patent shall cover, by suitable expression in the claims, such features of patentable novelty as exist in the invention.

What is claimed is:

1. A push-button lock for mounting on a door panel or the like at the location of a door panel opening having a front end region that opens through a front surface of the door panel and a rear end region that opens through a rear surface of the door panel, comprising:

a) flush mountable means including a flush mountable housing having a front surface defined in part by a relatively thin, perimetrically extending mounting flange that also defines a rear surface configured to overlie front surface portions of a door panel that surround a front end region of a door panel opening at a location where the lock is to be mounted so as to close the front end region of the opening, with the flush mountable housing also having central portions that are configured to extend rearwardly into the front end region of the door panel opening when the rear surface of the mounting flange is positioned to closely overlie said front surface portions, with the rearwardly extending central portions defining a finger-receiving recess that opens through said front surface, and a first push button passage that opens through said front surface at a first button opening, and that extends rearwardly from the first button opening and through the central portions of the flush mountable housing;

b) surface mountable means including a surface mountable housing having spaced front and rear faces that border central portions of the surface mountable housing which are perimetrically bounded by side wall means that connects the front and rear faces, with the rear face of the surface mountable housing having peripheral portions that are configured to overlie rear surface portions of the door panel that surround the rear end of the door panel opening at said location so as to close the rear end of the opening, with said central portions of the surface mountable housing defining a slide bolt passage 1) that is oriented transversely relative to the first push button passage, 2) that intersects the first push button passage, and 3) that has a passage end opening defined where the slide bolt passage opens through said side wall means, with said central portions of the surface mountable housing also defining a second push button passage 1) that substantially parallels the first push button passage, 2) that intersects with the slide bolt passage, and 3) that opens through said front face at a second button opening;

c) fastener means for mounting the flush mountable housing and the surface mountable housing on the door panel by clamping the flush mountable housing and the surface mountable housing toward each other at said location so that the flush mountable housing and the surface mountable housing close said front and rear end regions of the door panel opening, respectively;

d) an elongate slide bolt slidably mounted in the slide bolt passage for movement between latched and unlatched positions, with the slide bolt defining end formation means for projecting from said passage end opening when the slide bolt is in its latched position for latchingly engaging a suitably configured striker to latch the door panel in a closed position, and for retracting to disengage the striker when the slide bolt is in its unlatched position, with the slide bolt also defining 1) a first inclined cam surface that extends in a first plane that faces toward the first push button passage at an intersection of the first push button passage with the slide bolt passage, and 2) a second inclined cam surface that is oppositely inclined relative to the first inclined cam surface in that the second inclined cam surface extends in a second plane that faces away from the first push button passage and toward the second push button passage at an intersection of the second push button passage with the slide bolt passage;

e) biasing means for biasing the slide bolt away from its unlatched position toward its latched position;

f) first push button means slidably mounted in the first push button passage having an outer end region that is configured to project from said first button opening when the first push button means is in a normal position, and that can be moved to an operated position by depressing the outer end region of the first push button means, with the first push button means also defining first inner end means configured to engage and cooperate with the first inclined cam surface of the slide bolt when the first push button means is moved to its operated position to cause the slide bolt to retract to its unlatched position in opposition to the action of said biasing means;

g) second push button means slidably mounted in the second push button passage having an outer end region that is configured to project from said second button opening when the second push button means is in a normal position, and that can be moved to an operated position by depressing the outer end region of the second push button means, with the second push button means also defining second inner end means configured to engage and cooperate with the second inclined cam surface of the slide bolt when the second push button means is moved to its operated position to cause the slide bolt to retract to its unlatched position in opposition to the action of said biasing means;

h) wherein a selected one of said first and second inclined cam surfaces is defined by a single inclined surface situated within a cavity formed within the slide bolt at a location substantially centered between opposite sides of the slide bolt passage, and said other of the first and second inclined cam surfaces is defined by a pair of identically inclined surface portions formed on the slide bolt adjacent said opposite sides of the slide bolt passage, with the pair of identically inclined surface portions being located along the length of the slide bolt in sufficiently close proximity to said cavity to nest at least a portion of said cavity therebetween; and, i) wherein a selected one of the first and second inner end means is defined by a single, centrally located projection that extends into said cavity to engage said single inclined surface, and the other of the first and second inner end means is defined by a pair of spaced projections that extend into engagement with said pair of identically inclined surfaces.

2. The lock of claim 1 wherein the first push button means has a push button length that is chosen to correspond to a predetermined thickness of door panel on which the lock is to be mounted, with a correspondingly shorter push button length being selected if the thickness of the door panel on which the lock is to be mounted is relatively thinner, and with a correspondingly longer push button length being selected if the thickness of the door panel on which the lock is to be mounted is relatively thicker.

3. The lock of claim 1 additionally including:

a) locking cam means connected to the surface mountable housing for movement between a locked position wherein the locking cam means obstructs movement of the slide bolt from its latched position to its unlatched position, and an unlocked position wherein the locking cam means does not obstruct movement of the slide bolt; and, b) positioning means connected to at least a selected one of the flush mountable housing and the surface mountable housing for moving the locking cam means between its locked and unlocked positions.

4. The lock of claim 3 wherein the positioning means includes finger graspable means connected to the surface mountable housing for being moved between a locked position wherein the finger graspable means causes the locking cam means to be positioned in its locked position, and an unlocked position wherein the finger graspable means causes the locking cam means to be positioned in its unlocked position.

5. The lock of claim 3 wherein the positioning means includes key-operated lock means connected to the flush mountable housing for being operated by a suitably configured key for selectively positioning said locking cam means in its latched and unlatched positions.

6. The lock of claim 5 wherein the key-operated lock means includes an elongate lock cylinder that is mounted on the flush mountable housing for rotation about an axis that substantially parallels the first and second push button passages between a locked position wherein a rearwardly extending formation of the lock cylinder causes the locking cam means to be positioned in its locked position, and an unlocked position wherein said rearwardly extending formation causes the locking cam means to be positioned in its unlocked position.

7. The lock of claim 6 wherein the elongate lock cylinder has a length that is chosen to correspond to a predetermined thickness of door panel on which the lock is to be mounted, with a correspondingly shorter lock cylinder length being selected if the thickness of the door panel on which the lock is to be mounted is relatively thinner, and with a correspondingly longer lock cylinder length being selected if the thickness of the door panel on which the lock is to be mounted is relatively thicker.

8. The lock of claim 1 wherein the flush mountable housing additionally includes a finger graspable handle formation that overlies a portion of the finger-receiving recess that opens through said front surface, and that may be grasped to aid one in opening and closing the door panel.

9. The lock of claim 1 wherein the surface mountable housing defines at least one finger receiving formation that may be grasped to aid one in opening and closing the door panel.

10. The lock of claim 9 wherein a pair of finger receiving recesses are defined along opposed portions of the side wall means of the surface mountable housing.

11. The lock of claim 1 wherein the biasing means is positioned in the slide bolt passage and includes a compression coil spring having its opposite ends engaged by opposed surfaces, one of which is defined by the slide bolt, the other of which is defined by the surface mountable housing.

12. The lock of claim 1 wherein the surface mountable housing includes a mold-formed main member that defines the front face, the side wall means and a portion of the slide bolt passage, and a plate-like secondary member that defines at least a part of the rear face and at least a part of the slide bolt passage.

13. The lock of claim 12 wherein the plate-like secondary member is securely connected to the main member to form a surface mountable "assembly" that mounts the slide bolt and the biasing means.

14. The lock of claim 1 wherein:

a) the first and second parallel-extending push button passages have imaginary centerlines that intersect an imaginary centerline of the slide bolt passage at spaced locations along the length of the slide bolt passage; and, b) the first inclined cam surface and the second inclined cam surface that are defined by the slide bolt have imaginary centers that are spaced along the length of the slide bolt by a distance that substantially equals the spacing between the imaginary centerlines of the push button passages.

15. The lock of claim 1 wherein the push button means that defines said centrally located projection also defines another pair of spaced projections that parallel said centrally located projection at locations spaced symmetrically on opposite sides of said centrally located projection, and the surface mountable housing is configured to engage at least portions of said pair of projections to assist in guiding movements thereof relative to the surface mountable housing.

16. A push-button lock for mounting on a door panel or the like at the location of a door panel opening having a front end region that opens through a front surface of the door panel and a rear end region that opens through a rear surface of the door panel, comprising:

a) flush mountable means including a flush mountable housing having a front surface defined in part by a relatively thin, perimetrically extending mounting flange that also defines a rear surface configured to overlie front surface portions of a door panel that surround a front end region of a door panel opening at a location where the lock is to be mounted so as to close the front end region of the opening, with the flush mountable housing also having central portions that are configured to extend rearwardly into the front end region of the door panel opening when the rear surface of the mounting flange is positioned to closely overlie said front surface portions, with the rearwardly extending central portions defining a finger-receiving recess that opens through said front surface, and a first push button passage that opens through said front surface at a first button opening, and that extends rearwardly from the first button opening and through the central portions of the flush mountable housing;

b) surface mountable means including a surface mountable housing having spaced front and rear faces that border central portions of the surface mountable housing which are perimetrically bounded by side wall means that connects the front and rear faces, with the rear face of the surface mountable housing having peripheral portions that are configured to overlie rear surface portions of the door panel that surround the rear end of the door panel opening at said location so as to close the rear end of the opening, with said central portions of the surface mountable housing defining a slide bolt passage 1) that is oriented transversely relative to the first push button passage, 2) that intersects the first push button passage, and 3) that has a passage end opening defined where the slide bolt passage opens through said side wall means, with said central portions of the surface mountable housing also defining a second push button passage 1) that substantially parallels the first push button passage, 2) that intersects with the slide bolt passage, and 3) that opens through said front face at a second button opening;

c) fastener means for mounting the flush mountable housing and the surface mountable housing on the door panel by clamping the flush mountable housing and the surface mountable housing toward each other at said location so that the flush mountable housing and the surface mountable housing close said front and rear end regions of the door panel opening, respectively;

d) an elongate slide bolt slidably mounted in the slide bolt passage for movement between latched and unlatched positions, with the slide bolt defining end formation means for projecting from said passage end opening when the slide bolt is in its latched position for latchingly engaging a suitably configured striker to latch the door panel in a closed position, and for retracting to disengage the striker when the slide bolt is in its unlatched position, with the slide bolt also defining 1) a first inclined cam surface that faces toward the first push button passage at an intersection of the first push button passage and the slide bolt passage, and 2) a second inclined cam surface that faces toward the second push button passage at an intersection of the second push button passage;

e) biasing means for biasing the slide bolt away from its unlatched position toward its latched position;

f) first push button means slidably mounted in the first push button passage having an outer end region that is configured to project from said first button opening when the first push button means is in a normal position, and that can be moved to an operated position by depressing the outer end region of the first push button means, with the first push button means also defining first inner end means configured to engage and cooperate with the first inclined cam surface of the slide bolt when the first push button means is moved to its operated position to cause the slide bolt to retract to its unlatched position in opposition to the action of said biasing means;

g) second push button means slidably mounted in the second push button passage having an outer end region that is configured to project from said second button opening when the second push button means is in a normal position, and that can be moved to an operated position by depressing the outer end region of the second push button means, with the second push button means also defining second inner end means configured to engage and cooperate with the second inclined cam surface of the slide bolt when the second push button means is moved to its operated position to cause the slide bolt to retract to its unlatched position in opposition to the action of said biasing means;

h) wherein a selected one of said first and second inclined cam surfaces is defined by a single inclined surface defined within a cavity formed within the slide bolt at a location substantially centered between opposite sides of the slide bolt passage, and the other of the first and second inclined cam surfaces is defined by a pair of identically inclined surfaces formed on the slide bolt adjacent said opposite sides of the slide bolt passage;

i) wherein a selected one of the first and second inner end means is defined by a single, centrally located projection that extends into said cavity to engage said single inclined surface, and the other of the first and second inner end means is defined by a pair of spaced projections that extend into engagement with said pair of identically inclined surfaces; and, j) wherein the push button means that defines said centrally located projection also defines another pair of spaced projections that parallel said centrally located projection at locations spaced symmetrically on opposite sides of said centrally located projection, and the surface mountable housing is configured to engage at least portions of said pair of projections to assist in guiding movements thereof relative to the surface mountable housing.

17. A push-button lock for mounting on a door panel including an exterior housing and an interior housing that are configured to be clamped toward engagement with opposite side portions of the door panel to mount the lock on the door panel, with a selected one of the housings defining a slide bolt channel within which an elongate, spring-projected slide bolt is mounted for movement between latched and unlatched positions, with the exterior housing defining an exterior push button passage that intersects the slide bolt passage at a first location along the length of the slide bolt passage and within which an exterior push button is mounted for movement, with the interior housing defining an interior push button passage that substantially parallels the exterior push button passage and that intersects with the slide bolt passage at a second location along the length of the slide bolt passage and within which an interior push button is mounted for movement, and with the slide bolt having a pair of oppositely inclined cam surfaces formed at locations along the length of the slide bolt that are spaced apart by a distance that corresponds to the spacing between the locations where the exterior and interior push button passages intersect with the slide bolt passage, with the first and second oppositely inclined cam surfaces of the slide bolt extending substantially the full width of the slide bolt measured in a direction that parallels the exterior and interior push button passages and being configured to cooperate 1) with first inner end means defined by the exterior push button that engages the first inclined cam surface, and 2) with second inner end means defined by the interior push button that engages the second inclined cam surface for retracting the slide bolt from its latched position toward its unlatched position in response to depression of either of the exterior and interior push buttons, with a selected one of the first and second inner end means being defined by a central projection that extends into a cavity that is defined by the slide bolt at a location that is substantially centered between opposite side portions of the slide bolt for engaging one of said oppositely inclined cam surfaces which is defined by an inclined surface of the slide bolt located within said cavity, with the other of the first and second inner end means defined by a pair of spaced projections that extend along said opposite side portions of the slide bolt for engaging a pair of identically inclined surface portions that are formed on said opposite side portions of the slide bolt to extend in a common plane, with the pair of inclined surface portions 1) defining the other of said oppositely inclined cam surfaces and 2) being located along the length of the slide bolt at a position where the inclined surface portions nest therebetween at least a portion of said cavity.

18. The lock of claim 17 wherein the push button that defines said center projection also defines another pair of spaced projections that parallel said center projection at locations spaced symmetrically on opposite sides of said center projection, and at least a chosen one of the exterior and interior housings is configured to engage at least portions of said pair of projections to assist in guiding movements thereof relative thereto.

19. The lock of claim 17 additionally including key-locking means carried by the exterior housing for selectively moving locking cam means that is carried by a chosen one of the exterior and interior housings between a locked position wherein the locking cam means obstructs retraction of the slide bolt from its latched position, and an unlocked position wherein the locking cam means does not obstruct retraction of the slide bolt.

20. The lock of claim 19 additionally including manually operable locking means carried by the interior housing that is manually movable between locked and unlocked positions, and that is rigidly connected to the locking cam means for positioning the locking cam means in its locked position when the manually operable locking means is positioned in its locked position, and for positioning the locking cam means in its unlocked position when the manually operable locking means is positioned in its unlocked position.

21. The lock of claim 18 wherein the exterior housing is a flush mountable housing having a front surface defined in part by a relatively thin, perimetrically extending mounting flange that also defines a rear surface configured to overlie front surface portions of a door panel that surround a front end region of a door panel opening at a location where the lock is to be mounted so as to close the front end region of the opening, with the flush mountable housing also having central portions that are configured to extend rearwardly into the front end region of the door panel opening when the rear surface of the mounting flange is positioned to closely overlie said front surface portions, with the rearwardly extending central portions defining a finger-receiving recess that opens through said front surface.

22. The lock of claim 17 wherein the interior housing includes a surface mountable housing having spaced front and rear faces that border central portions of the surface mountable housing which are operimetrically bounded by side wall means that connects the front and rear faces, with the rear face of the surface mountable housing having peripheral portions that are configured to overlie rear surface portions of the door panel that surround the rear end of the door panel opening at said location so as to close the rear end of the opening, with said central portions of the surface mountable housing defining said slide bolt passage, and with said slide bolt passage being configured to open through the side wall means.

23. The lock of claim 17 wherein the spring-projected slide bolt is engaged by one end of a compression coil spring that has its other end engaged by a portion of the selected housing that defines the slide bolt passage.

24. The lock of claim 17 additionally including:

a) locking cam means connected to the selected housing that defines the slide bolt passage, with the locking cam means being movable between a locked position wherein the locking cam means obstructs movement of the slide bolt from its latched position to its unlatched position, and an unlocked position wherein the locking cam means does not obstruct movement of the slide bolt; and, b) positioning means connected to at least a selected one of the flush mountable housing and the surface mountable housing for moving the locking cam means between its locked and unlocked positions.

25. The lock of claim 24 wherein the positioning means includes finger graspable means connected to the selected housing that defines the slide bolt passage for being moved between a locked position wherein the finger graspable means causes the locking cam means to be positioned in its locked position, and an unlocked position wherein the finger graspable means causes the locking cam means to be positioned in its unlocked position.

26. The lock of claim 24 wherein the positioning means includes key-operated lock means connected to the exterior housing for being operated by a suitably configured key for selectively positioning said locking cam means in its latched and unlatched positions.

27. The lock of claim 17 wherein the exterior housing includes a finger receiving formation that may be grasped to aid one in opening and closing the door panel.

28. The lock of claim 17 wherein the interior housing includes a finger receiving formation that may be grasped to aid one in opening and closing the door panel.

29. The lock of claim 17 wherein the interior housing includes a mold-formed main member that defines at least a portion of the slide bolt passage, and a plate-like secondary member that is rigidly connected to the main member and also defines at least a part of the slide bolt passage.

30. A push button lock for mounting at an opening formed through a door panel near an edge of the door, comprising a flush mountable exterior housing having a thin mounting flange that encircles central portions of the exterior housing that are configured to extend into the door panel opening; and a surface mountable interior housing that defines a slide bolt passage that carries a spring-projected slide bolt having an end formation that is configured to extend out of the slide bolt passage when in its latched position to latchingly engage a suitably configured striker for retaining the door panel closed, and to be retractable from its latched position to an unlatched position wherein the slide bolt is disengaged from the striker; with the interior housing and the mounting flange of the exterior housing being configured to overlap and to be clamped toward engagement with interior and exterior door panel surfaces that extend closely about the door panel opening; with the interior and exterior housings defining separate interior and exterior push button passages, respectively, that intersect with the slide bolt passage; with separate interior and exterior push buttons being provided that each are slidably mounted in a passages, respectively; with inner end regions of the interior and exterior push buttons defining separate, oppositely inclined cam surfaces that are engageable with interior-facing and exterior-facing, oppositely inclined cam surfaces that are defined by the slide bolt at locations where the interior and exterior push button passages intersect with the slide bolt passage, respectively; with the interior-facing and the exterior-facing inclined cam surfaces being configured to cooperate with the interior and exterior push buttons, respectively, to cause retraction of the slide bolt from its latched position when either of the interior and exterior push buttons is depressed, with a selected one of the interior-facing and the exterior-facing inclined cam surfaces of the slide bolt being defined by a single inclined surface defined within a cavity formed in the slide bolt at a location substantially centered between opposite sides of the slide bolt passage, with the other of the interior-facing and the exterior-facing inclined cam surfaces being defined by a pair of identically inclined surface portions of the slide bolt that extend in a common plane along opposite sides of the slide bolt passage at a location along the length of the slide bolt where the identically inclined surface portions nest at least a portion of said cavity therebetween, with a selected one of the inclined cam surfaces of the push buttons being defined by a single, centrally located projection that extends into said cavity to engage said single inclined surface, and with the other of the inclined cam surfaces of the push buttons being defined by a pair of spaced projections that extend into engagement with said pair of identically inclined surface portions.

31. The lock of claim 30 wherein the push button that defines said centrally located projection also defines another pair of spaced projections that parallel said centrally located projection at locations spaced symmetrically on opposite sides of said centrally located projection, and at least a chosen one of the exterior and interior housing is configured to engage at least portions of said pair of projections to assist in guiding movements thereof relative thereto.

32. The lock of claim 30 additionally including a key-operated lock cylinder carried by the exterior housing and a pivotal locking knob carried by the interior housing that both are connected to a locking cam which is movable between a locked position that obstructs retraction of the slide bolt and an unlocked position that permits slide bolt retraction, with each of the key-operated lock cylinder and the pivotal locking knob being independently operable to move the locking cam between its locked and unlocked positions.

* * * * *

UNITED STATES PATENT AND TRADEMARK OFFICE

CERTIFICATE OF CORRECTION

PATENT NO. : 5,689,980

DATED : November 25, 1997

INVENTOR(S) : Weinerman, et. al.

It is certified that error appears in the above-identified patent and that said Letters Patent is hereby corrected as shown below:

Column 18, line 25, "Claim 18" should read --Claim 17--.

Column 18, line 42, "operimetrically" should read-- perimetrically--.

Signed and Sealed this

Tenth Day of February, 1998

*Attest:*

*Attesting Officer*

BRUCE LEHMAN

*Commissioner of Patents and Trademarks*